US005894891A

United States Patent [19]

Rosenstock et al.

[11] Patent Number: 5,894,891

[45] Date of Patent: Apr. 20, 1999

[54] METHOD AND DEVICE FOR EXTINGUISHING FIRES

[75] Inventors: Winfried Rosenstock, Bueckeburg; Reinhard Ries, Bad Vilbel, both of Germany

[73] Assignee: Amrona AG, Switzerland

[21] Appl. No.: 08/649,640

[22] PCT Filed: Jul. 26, 1995

[86] PCT No.: PCT/EP95/02964

§ 371 Date: Sep. 27, 1996

§ 102(e) Date: Sep. 27, 1996

[87] PCT Pub. No.: WO96/04960

PCT Pub. Date: Feb. 22, 1996

[30] Foreign Application Priority Data

Aug. 8, 1994 [DE] Germany ..... 44 27 889
Jan. 10, 1995 [DE] Germany ..... 195 00 477

[51] Int. Cl.[6] ..... A62C 35/08
[52] U.S. Cl. ..... 169/28; 169/35; 169/36
[58] Field of Search ..... 169/35, 28, 36

[56] References Cited

U.S. PATENT DOCUMENTS 1,119,799 12/1914 Bowman .
3,878,897 4/1975 Goffart ..... 169/58
3,980,139 9/1976 Kirk .
5,050,683 9/1991 Sayles .
5,088,560 2/1992 Fawal ..... 169/28

FOREIGN PATENT DOCUMENTS 0 390 384 3/1990 European Pat. Off. .
0 488 536 A1 3/1992 European Pat. Off. .
1473621 6/1967 France .

*Primary Examiner*—Gary C. Hoge
*Attorney, Agent, or Firm*—Cesari and McKenna, LLP

[57] ABSTRACT

What is disclosed is a device for extinguishing fires, and utilization of the device for stationary protection of specific objects, and for dust abatement during blasting operations, and a method for extinguishing forest or terrain fires with the extinguishing device. The extinguishing device comprises a container for receiving an extinguishing agent, and an explosive in or on this container, by means of detonation of which the extinguishing agent is atomized to form a mist and brought into the fire. In order to increase the flexibility and effectiveness in practical use, the container consists of a flexible hose which may be closed at both ends. The method of extinguishing forest or terrain fires with this device provides for the hose to be laid out in front of the fire front, filled with the extinguishing agent, and exploded by detonation of the explosive.

11 Claims, 4 Drawing Sheets

METHOD AND DEVICE FOR EXTINGUISHING FIRES

The present invention relates to a device for extinguishing fires, with a container for receiving an extinguishing agent, and with an explosive in or on said container, by means of the detonation of which the extinguishing agent is atomized to form a mist and is applied to the fire. The invention further relates to a method of extinguishing forest or terrain fires with the described device.

BACKGROUND OF THE INVENTION

Atomization of an extinguishing agent into microfine particles by means of an explosive with the aim of extinguishing fires, is known. During detonation of a preferably high-explosive charge within or in the vicinity of a homogenous medium such as, for example, water, a pressure of several thousand bar is developed, so that the water is atomized into microfine particles and is thrown by the resultant pressure wave from the center of the explosive charge into the surrounding area. By a high-explosive charge is meant one which develops a detonation wave with a propagation speed of above 5000 meters per second. The mist of extinguishing agent, such agent used, and due to the small size of the individual droplets of extinguishing agent in relation to amount of such agent used, surface area, by means of which the extinguishing agent is applied to the fire in the neighborhood of the detonated container and extinguishes it by means of the known supercooling effect. In addition, the extinguishing effect during detonation of an extinguishing agent also results in a known way from the blowing-out effect of the detonation wave.

There are known from U.S. Pat. No. 1,119,779 and from EP 390 384 fire extinguishers provided for stationary use, and which utilized the effect described above of detonation of an extinguishing agent. These known devices for extinguishing fires have a cylindrical container for receiving an extinguishing agent, and a concentrically-disposed elongate internal container which extends in the longitudinal direction in the extinguishing agent container, and which is filled with an explosive charge.

From EP 488 536 there is known such a fire extinguisher, in which the explosive charge, in contrast to the fire extinguishers described above, is attached externally to the extinguishing agent container.

U.S. Pat. No. 3,980,139 and FR 1 473 621 respectively disclose a "fire-extinguishing bomb" comprising a cylindrical glass or plastics container for receiving an extinguishing agent, and also comprising a cylindrical, concentrically-disposed internal container, which in turn contains the explosive material. The difference between these fire-extinguishing bombs and the fire extinguishers described before consists purely in the ignition of the explosive, which is effected in the bombs either by a radio signal or by the effect of heat when the fire-extinguishing bomb is thrown into a fire.

All the fire-extinguishing devices described above have a common disadvantage, namely that, in practical use in extinguishing fires, they are insufficiently flexible and effective. Thus stationary fire extinguishers always have only a localized effect, so that fire-protection over a large area, or also in large-area firefighting, are impracticable for economic reasons, as too many of this type of fire-extinguisher would have to be used. With respect to mobile firefighting, for example in forest or other terrain fires, the "fire-extinguishing bombs" described have proved disadvantageous, as when the extinguishing bomb is launched they do not exert a directed extinguishing effect due to the detonation, and moreover, rather fan the flames when they are ignited in the center of the fire. Finally, launching these extinguishing devices over the seat of the fire is, to a great extent, complex and cost-intensive, not to mention unsatisfactory as regards hit accuracy.

SUMMARY OF THE INVENTION

The object underlying the present invention is to indicate a more adaptive and effective device for extinguishing fires.

This object is fulfilled by the device for extinguishing fires and by the method for extinguishing forest or terrain fires specified in the claims with the features of.

Both the device according to the invention and the method have a whole series of advantages which considerably increase their effectiveness in firefighting. For the purposes of the following description of the advantages, the term "mobile" firefighting should be taken to mean extinguishing of fires by task forces. Such fires are for, example, forest or terrain fires, or also fires in industrial installations or normal buildings. "Stationary" firefighting should be taken to mean extinguishing fires by means of an extinguishing device according to the invention which is permanently installed and ready for use at the site at risk. The installations or structures to be protected in this way cover a wide range; this may contain for example oil or gas tanks, refineries, oil drilling or pumping installations, runways or fueling areas in airports, and similar.

In mobile use, the extinguishing device according to the invention is characterized in that it is adaptable over almost unrestricted lengths to the configuration of the flame front, and thus to the threat. Thus the hose, at first not filled with extinguishing agent, is unrolled like a conventional firefighting hose, for example from drums, and is laid out. Thus an almost limitless spatial usable width is obtained. When a plurality of hose lines are spaced out parallel to one another, a plurality of firefighting lines may be produced, and thus an operational depth of almost any magnitude. The flexible hose may be manufactured by the metre, and is easily transportable when rolled up.

These advantages make it clear that the extinguishing device according to the invention is outstandingly suitable for combating a large fire. By means of corresponding layout of the flexible hose, the fire may be "contained", to use the technical term for encirclement of the seat of a fire, while at the same time fighting it from all sides.

With regard to stationary firefighting, i.e. in particular for industrial applications, the extinguishing device according to the invention is characterized likewise by its high degree of flexibility in layout. As even the smallest layout radii are possible, the extinguishing device can, for example, when installed in a warehouse, be passed around installation components such as shelving or the like, or around constructive obstacles such as pillars or the like. It may also be imagined that the flexible hose may be suspended above high shelving. Here also then maximum adaptation of the stationary extinguishing device to potential center of risk is possible.

It should be named as an advantage of the device according to the invention, both for mobile and for stationary firefighting, that the mist of extinguishing agent may be produced rapidly, flexibly and economically at the site of the event. The basic materials required for this purpose, i.e. water and if necessary an extinguishing additive ("RETARDER"), as well as the explosive, may be stored without difficulty and for long periods in a small space, and moreover, are easily transportable. It follows from this that the device according to the invention for stationary fire protection may be permanently installed or—for mobile firefighting—may be variably used on site, even where conventional extinguishing methods fail, for example due to shortage of water. Furthermore, different classes of fire may be securely extinguished by the device according to the invention. As due to the increase in surface area because of atomization of the extinguishing agent, a relatively small amount of extinguishing agent is used, considerably less damage is caused in firefighting than when conventional extinguishing methods are used. Neither proper detonation itself, nor the atomized extinguishing agent, represent any risk to the environment of the fire. When the extinguishing device is used in industries which manufacture or process pulverulent products, it is in addition of great advantage that the powder is bound by the mist of extinguishing agent over a large surface after a dust explosion or the like.

Advantageous further developments of the invention are given in the dependent claims.

Two alternative forms are provided of the explosive material extending linearly in or on the container: on the one hand, the explosive may be in the form of a flexible explosive cord extending longitudinally along the hose, and on the other hand, discrete linear explosive charges may be provided, which are likewise distributed at regular intervals in or on the hose. An advantage common to both forms of the explosive is that the hose, with explosive, may be produced as a completed product by the meter. This reduces both manufacturing costs and also the time required for its utilization on site.

The flexible hose preferably consists of a thin-walled, but resistant, material. The selection of the hose material is effected from the viewpoint that it is as resistant as necessary, and as flexible as possible. In this connection, the resistance during mobile use is intended merely to ensure that when the hose is laid out and subsequently filled with extinguishing agent, no holes will be made in it by branches or sharp stones. Flexibility will be in terms of the criteria that the hose is to be capable of being rolled up, and that the smallest layout radii are possible. Furthermore, the hose should have the smallest possible intrinsic weight. Preferably used are thin-walled plastics hoses which might be described as "burstable" within the framework of the above requirements. By means of the described selection of the hose material, also, danger to persons by projection of hard materials such as are for example used in the known fire-extinguishing bombs or the like, is avoided. Even hard PVC could be a risk to personnel, even at a large distance.

The hose also has protection against radiated heat, consisting for example of white material or of an aluminium coating.

Whereas the hose will normally have a circular cross-section, it may also be envisaged for special applications that the hose in the filled condition has a triangular cross-section. This cross-section enables a stable position of the hose and thus the opportunity of identifying by color a specific side of the triangle, which is intended to face the seat of the fire. This is of particular advantage when the explosive cord is located in the angle of the triangular hose which lies opposite the side of the triangle facing the seat of the fire. Thus a directed explosive effect can be achieved in a particularly effective way. This may be further reinforced by the fact that the side of the triangular hose facing the seat of the fire is weaker in construction that the two other sides.

One aim of the hose filled with extinguishing agent is to take as much pressure as possible from the lower surface upon which the hose rests, in order to bring as much extinguishing agent as possible into the air. For this purpose, the explosive, i.e. for example one or more explosive cords, is/are preferably disposed at a spacing of approximately one-third of the hose diameter from the ground or from a retaining means upon which the hose rests. Such positioning is most simply realized in that two hoses are glued together in parallel, and the explosive cord is contained between the two hoses in contact with each other. Raising the explosive cord from the underlying surface achieves an outstanding distribution and direction of the mist of extinguishing agent.

When using the extinguishing device for stationary protection of specific objects, the hose with the explosive is disposed on a longitudinally-extended carrier which, in cross-section, is for example shell-shaped or angled. In this way, on the one hand, a stable mount is obtained for the hose, and, on the other hand, a directed effect upon detonation of the extinguishing agent, as the hose is shielded at the rear by the carrier, while the effect in the forward direction, towards the center of the risk, is not impaired.

The advantage of a stable stationary mounting for the ready-to-use extinguisher hose can be seen in the fact that the hose, on the carrier, can preferably be permanently filled with the extinguishing agent.

The extinguishing device according to the invention, in addition to being a fire-protection device for specific objects for stationary installations or devices, is also suitable for dust abatement during blasting operations, for example when destroying buildings by blasting, when the hose, laid at least partly around the object to be blasted, is filled with water and is detonated by ignition of the explosive when the dust front occurs. If necessary a plurality of protective walls may be laid around the object to be blasted, which are then detonated in timed sequence. In this way, it is possible to effectively counteract the serious dust nuisance which previously occurred during blasting of buildings.

The extinguishing device according to the invention may in addition be used as a preventative fire-protection device at or on an airport runway or an aircraft parking area. It is known from prior art as a preventative measure, upon announcement of an emergency landing of an aircraft, to apply a foam carpet approximately 1000 meters long and 60 meters wide to the runway. The time required for this, however, is 45 to 60 minutes, and the cost of the equipment required is extremely high. Foaming of runways has been discontinued for some time, as in addition to the enormous outlay in time and cost, the logic of such foaming has been questioned. The aircraft executing an emergency landing can become uncontrollable due to the foam carpet, and may sheer laterally off the runway, so that rescue operations are rather hindered by this. In this connection the critical moment and thus also the critical position during the emergency landing is only reached when the aircraft comes to a halt, and leaking fuel is ignited. The extinguishing device takes effect precisely at this point, the hose, laid out along the runway and filled with the extinguishing agent, being detonated at the critical moment by ignition of the explosive. The microfine particles of extinguishing agent produced by the detonation rain down on the activated critical area, and form a surface film which leads in a minimum space of time to an enclosed surface, thus preventing ignition of the fuel.

A further possible use for the extinguishing device according to the invention consists in preventative fire protection of an aircraft parking position, where aircraft as a rule are also refuelled. It may be envisaged at this point that a hose line may be installed between the aircraft and the terminal building, said hose line being permanently filled with extinguishing agent and, in an emergency, laying a microfine film of extinguishing agent over the protected area by detonation.

BRIEF DESCRIPTION OF THE DRAWINGS

The invention will be explained in more detail in the following description of some embodiments and with reference to the drawings, which shows.

DESCRIPTION OF THE PREFERRED EMBODIMENTS

Figure 1:
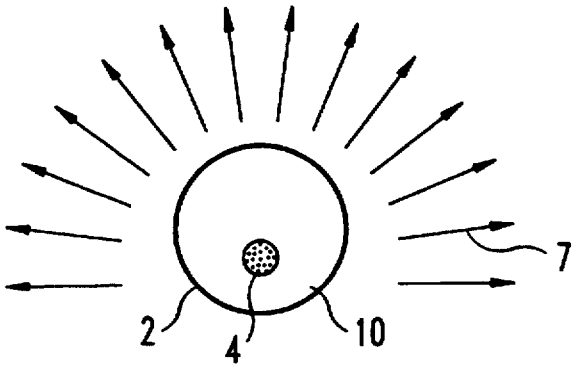
FIG. 1: a diagrammatic cross-section of an explosive extinguishing hose with internal explosive.

In the drawing figures, the arrows 7 respectively show the principal direction of propagation of the detonated extinguishing agent, and of the pressure wave.

FIG. 1 shows a flexible hose 2 of circular cross-section and of optional length comprising a thin-walled plastics material, filled with an extinguishing agent 10. At the point where the hose 2 rests on the ground (not shown), there extends within the hose, at a distance of approximately one-third of the hose diameter from the ground, a linear flexible explosive cord 4 consisting of high explosive, which is water-resistant, burns only with difficulty and may be stored almost indefinitely. With these properties, the explosive may be used both in a mobile and in a stationary application of the extinguishing device. When the explosive cord 4 is ignited, the extinguishing agent, due to the high pressure, is atomized in fractions of a second to form microfine droplets of extinguishing agent, and is almost uniformly distributed in all directions in the direction of the arrows 7. Thus there results a delivery, approximately semicircular in cross-section, of the mist of extinguishing agent to the surroundings.

Figure 5:
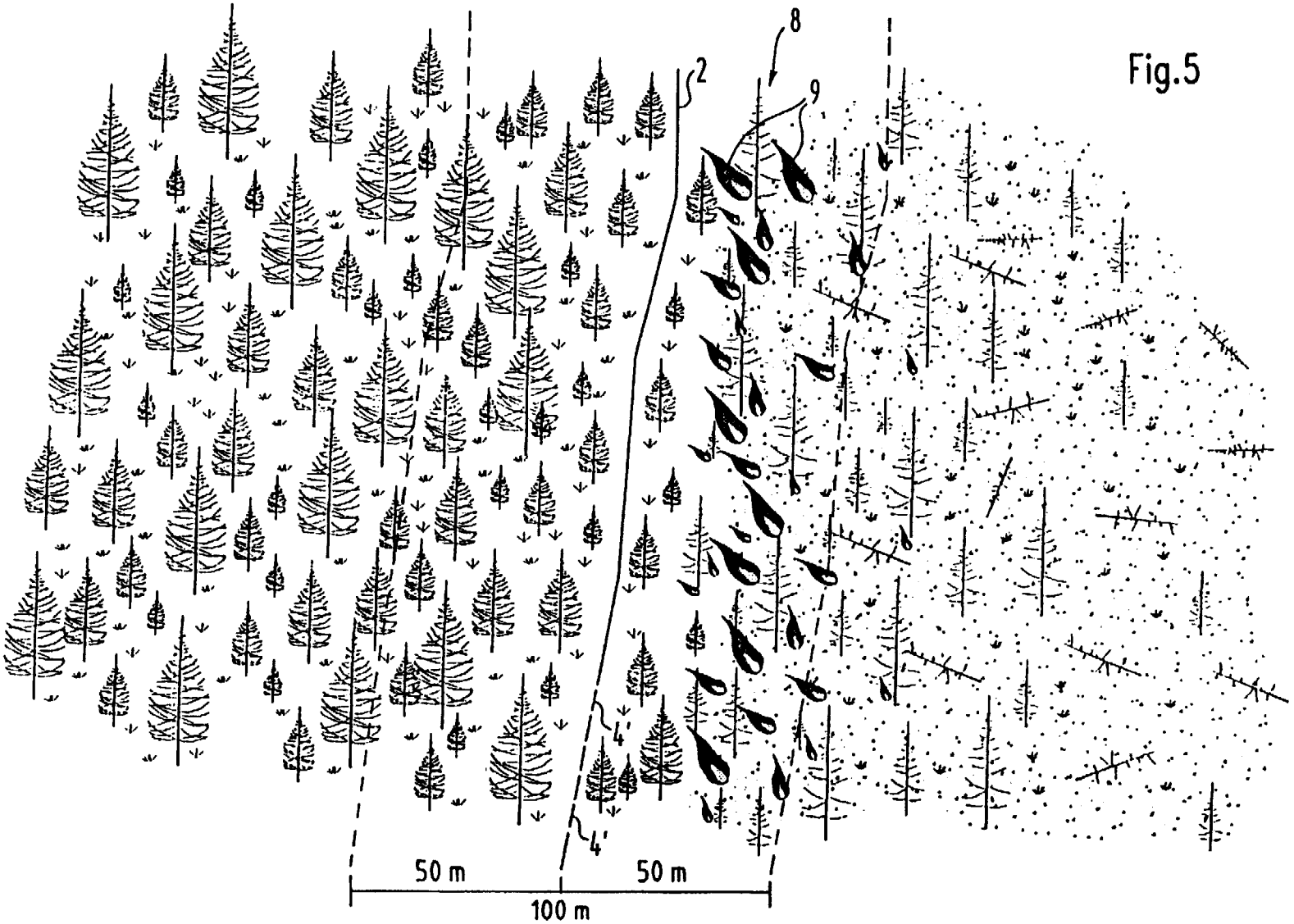
FIG. 5: a diagrammatic front elevation of a forest fire with a linear configuration of the flame front.

Alternatively, the cord may consist of a series of discrete explosive charges distributed along the hose 2 as shown at 4 in FIG. 5.

Figure 2:
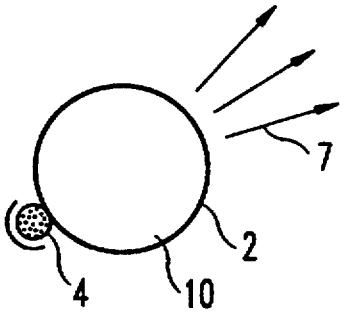
FIG. 2: a diagrammatic cross-section of an explosive extinguishing hose with external explosive.

If, instead, as FIG. 2 shows, the explosive cord 4 is disposed outside the filled hose 2, a substantially directed explosive and extinguishing effect may be achieved. In this case, the explosive cord 4 is positioned on the side of the hose 2 facing away from the seat of the fire, on the ground (not shown). In this way the fire is likewise highly effectively combated; more than 50% of the extinguishing agent can develop a direct extinguishing effect.

Figure 3:
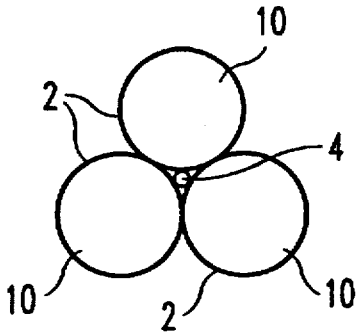
FIG. 3: a diagrammatic cross-section of a hose bundle comprising three explosive extinguishing hoses.

In many cases it can be meaningful to form a hose bundle from a plurality of hoses 2, as shown in diagrammatic cross-section in FIG. 3. In this case the explosive cord 4 is located in the center of the hose bundle. Naturally, other positioning may be envisaged, up to and including the use of a plurality of explosive cords at various points.

Figure 4:
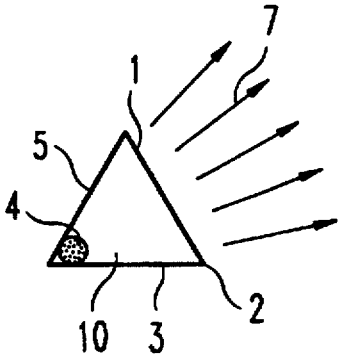
FIG. 4: a diagrammatic cross-section of a triangular explosive extinguishing hose.

FIG. 4 shows a different cross-sectional shape of the hose 2. The hose 2 illustrated therein has a triangular cross-sectional shape, and the explosive cord 4 is located in the angle of the triangular hose 2 which lies opposite the triangle side or hose wall 1 facing the seat of the fire. A substantially directed explosive and extinguishing effect in the direction of arrows 7 are also achievable by this arrangement. This directional effect might for example be reinforced by the fact that the side 1 of the hose 2 facing the seat of the fire is made of weaker material than the two other triangle sides 3, 5. Moreover, the side 1 may be color-coded, in order to ensure when the extinguishing device is laid out that the explosive cord located in the hose is correctly positioned in relation to the seat of the fire or the direction of risk.

FIG. 5 shows a diagram of a forest fire. In this illustration, the fire front moves from the right to the left. In order to extinguish the fire, a hose according to FIG. 1, for example, with the explosive cord 4 contained therein, has been laid out along the entire fire front 8 and filled with extinguishing agent. When the explosive cord 4 is detonated, the extinguishing agent, atomized to form a mist, spreads to both sides of the hose 2 over a width of 50 meters in each case. The flames 9 are extinguished in the way described above, both by the supercooling effect, and by the detonation wave resulting from the explosion. On the opposite side of the hose 2, the area of the forest not affected by the fire front 8, has been wetted by the mist of extinguishing agent.

Figure 6:
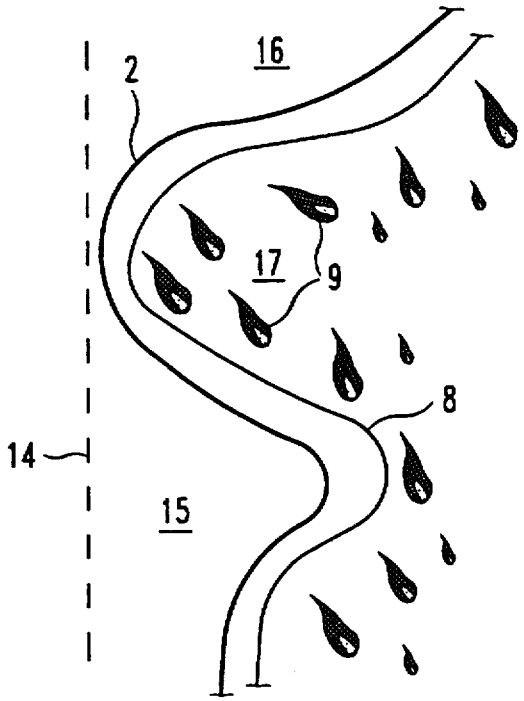
FIG. 6: a diagrammatic front elevation of a forest fire with an irregular configuration of the flame front.

FIG. 6 shows a diagrammatic view of an irregularly-conformed fire front 8. An advantage of the extinguishing device according to the invention is particularly clearly shown by this illustration: if the fire was fought with known non-flexible extinguishing devices, for example by interconnection of rigid extinguishing agent containers along the line 14 shown in dashed lines, the extinguishing agent included in the containers would, after detonation, affect only the furthest-advanced area 17 of the fire front 8, whereas no extinguishing effect would be achieved in the areas 15, 16. In contrast to this, the flexible extinguishing agent hose 2 enables adaptation of the firefighting line to the configuration of the flame front 8, and thus highly effective use of the extinguishing agent. Moreover, the extinguishing device can be brought into use in the shortest time, as the hose 2 can be laid out in front of the fire front 8 like a normal C hose, filled with extinguishing agent 10, and exploded by detonation of the explosive. Thus, due to the surface enlargement of the extinguishing agent as a result of atomization to form a fine mist, an optimum degree of effectiveness of the amount of extinguishing agent used can be achieved. Furthermore, use of the method according to the invention is ecologically harmless. The use of extinguishing agent leaves scarcely any traces behind it, and the loss of biomass may be reduced to a minimum by the high efficiency of the method.

Figure 7:
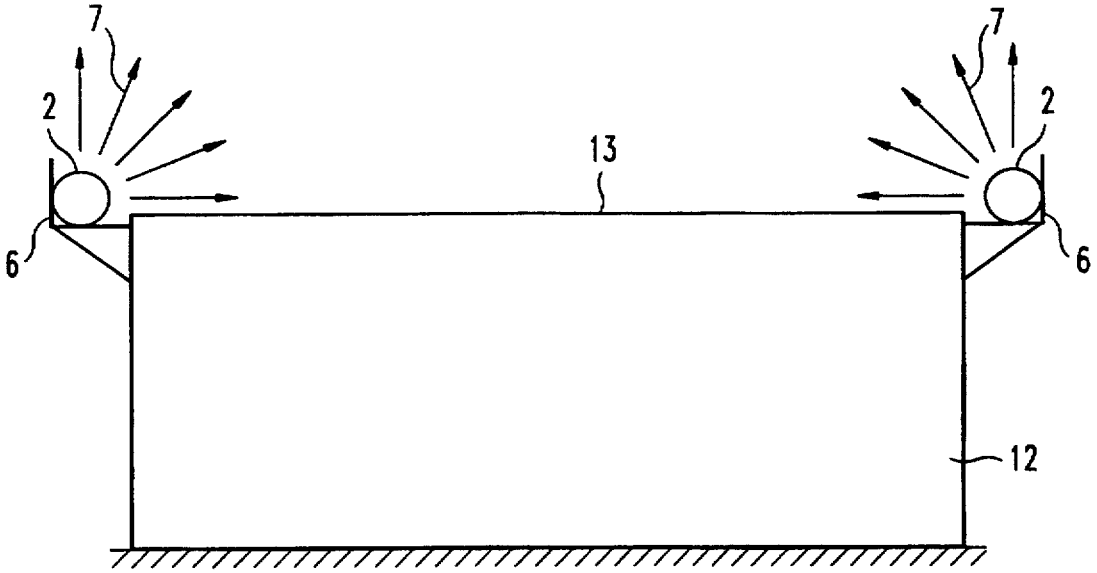
FIG. 7: a diagrammatic illustration of an oil tank with a stationary extinguishing device, in cross-section.

FIG. 7 shows an example for a stationary application of the extinguishing device, in the protection of specific objects. Shown in a diagrammatic cross-section of an oil tank 12, which has level with its upper edge 13 a surrounding bracket-like carrier 6 of angular cross-section. Resting on the carrier 6 is the hose 2, filled with extinguishing agent. The position of the explosive cord 4, not shown here, is of secondary importance in this case. Alignment of the explosive and extinguishing effect in the direction of the arrow 7 is achieved in this embodiment by the shielding of the hose on the rear side by the carrier 6. The extinguishing device is automatically detonated by sensors when the fuel in the tank 12 ignites. Immediately after the detonation the mist of extinguishing agent is laid like a lid over the burning fuel, and extinguishes the fire in the way described above. The stationary application thus described for the extinguishing device may of course also be transferred to the protection of high-level shelving in warehouses or the like.

Figure 8:
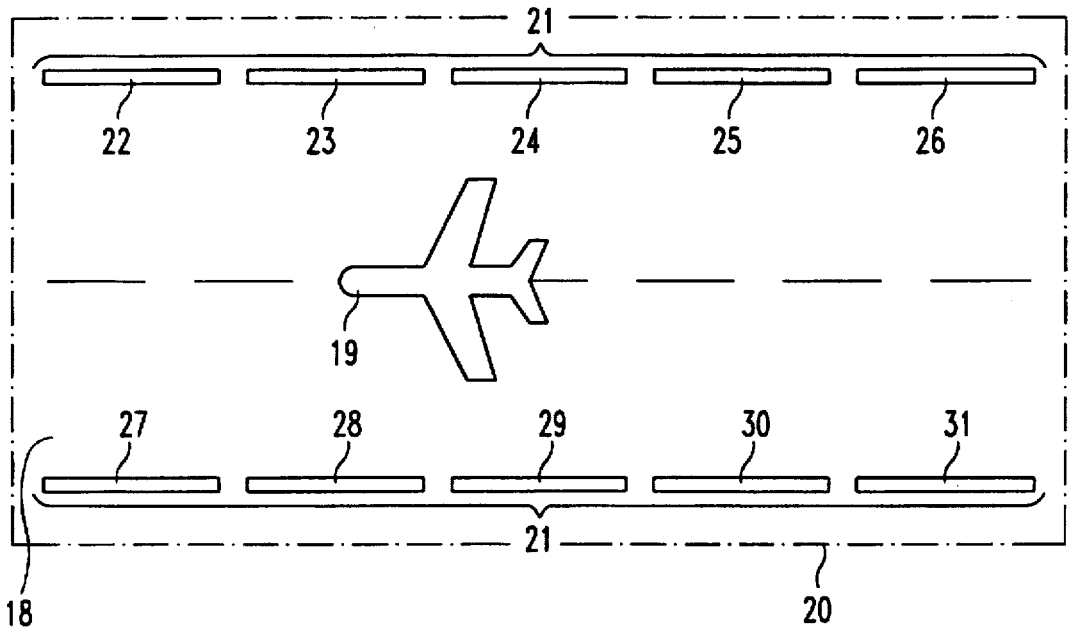
FIG. 8: a diagrammatic illustration of an airport runway with stationary extinguishing device, in plan view.

FIG. 8 shows a diagrammatic plan view of an airport runway 18, with an aircraft 19 located thereon. The area on a runway 18 upon which an aircraft 19 comes to a halt after an emergency landing, is termed a critical area 20, which is indicated here by a dashed/dotted line. This critical area is approximately 600 to 1000 meters long, and its position can be generally predicted for every aircraft type. To the left and right of the runway 18 are, for example, respectively 5 lengths of hoses 21, in ten segments 22 to 31 in all. Depending on where the aircraft 19 comes to a halt during an emergency landing, the corresponding segments 22 to 31 are activated. As a plurality of such hoses 21 may be arranged parallel next to one another, a second row of hoses (not shown here) could be used as a so-called "second alarm wave", which will be activated if the supply of extinguishing agent in the extinguishing vehicles is exhausted.

We claim:

1. A device for extinguishing fires, with a container for receiving an extinguishing agent, and with an explosive in or on said container, by means of the detonation of which the extinguishing agent is atomized to form a mist and is applied to the fire, characterised in that the container is a flexible hose (2) closable at both ends.

2. A device according to claim 1, characterised in that the explosive is in the form of a flexible explosive cord (4) which extends in the longitudinal direction of the hose (2).

3. A device according to claim 1, characterised in that the explosive is in the form of discrete linear explosive charges, and is distributed at regular intervals.

4. The device according to one of claims 1 to 3, characterised in that the hose (2) comprises a thin-walled but resistant material.

5. The device according to one of claims 1 to 3, characterised in that the hose (2) comprises a material reflective of radiant heat, or has a protective coating for this purpose.

6. The device according to one of claims 1 to 3, characterised in that the explosive is located at a distance of approximately one-third of the hose diameter away from the ground or from a retaining means upon which the hose (2) rests.

7. The device according to one of claims 1 to 3, characterised in that the hose (2) is disposed with the explosive on a longitudinally-extended carrier (6) which is, for example, shell-shaped or angled in cross-section.

8. A use of the device according to one of claims 1 to 3 as a fire-protection device for specific objects, for stationary installations or devices.

9. The use of the device according to one or more of claims 1 to 7 for dust-abatement during blasting operations, characterised in that the hose is laid at least partly around the object to be blasted, is filled with water and is detonated by ignition of the explosive when the dust front arises.

10. The use of the device according to one or more of claims 1 to 7 as a preventative fire-protection device at or on an aircraft runway, or an aircraft parking area, characterised in that the hose (2) is laid out at least partly along the runway or around the parking area to be protected, is filled with the extinguishing agent (10), and is detonated by ignition of the explosive when a fire risk occurs.

11. A method of extinguishing forest or terrain fires with a device according to one of claims 1 to 3, characterised in that the hose (2) is laid out in front of the flame front (8), is filled with the extinguishing agent (10) and is detonated by ignition of the explosive.

* * * * *